US011534633B2

(12) United States Patent
Cowell et al.

(10) Patent No.: US 11,534,633 B2
(45) Date of Patent: Dec. 27, 2022

(54) HARNESSES

(71) Applicant: Treemagineers Ltd., Scotland (GB)

(72) Inventors: Christopher Sidney Cowell, Scotland (GB); Elliot James Tanner, North Wales (GB)

(73) Assignee: TREEMAGINEERS LTD., Pitlochry (GB)

( * ) Notice: Subject to any disclaimer, the term of this patent is extended or adjusted under 35 U.S.C. 154(b) by 82 days.

(21) Appl. No.: 15/832,808

(22) Filed: Dec. 6, 2017

(65) Prior Publication Data

US 2018/0154196 A1 Jun. 7, 2018

(30) Foreign Application Priority Data

Dec. 6, 2016 (GB) ..... 1620695

(51) Int. Cl.
*A62B 35/00* (2006.01)

(52) U.S. Cl.
CPC ..... *A62B 35/0006* (2013.01); *A62B 35/0012* (2013.01); *A62B 35/0031* (2013.01); *A62B 35/0037* (2013.01)

(58) Field of Classification Search
CPC . A63B 27/00; A63B 35/0037; A63B 35/0031; A63B 35/0006; Y10T 29/49826; Y10T 403/32041
See application file for complete search history.

(56) References Cited

U.S. PATENT DOCUMENTS 2,254,179 A * 8/1941 Hoyt ..... B63B 27/14 182/7
2,581,772 A * 1/1952 Rose ..... A62B 35/0075 182/4
3,335,468 A 8/1967 Harley
4,474,261 A * 10/1984 Mader ..... B63H 8/54 182/3
4,546,851 A * 10/1985 Brennan ..... A62B 35/0075 182/7

(Continued)

FOREIGN PATENT DOCUMENTS

DE 29917619 U1 12/1999
EP 1712259 A2 * 10/2006 ..... A62B 35/0037

(Continued)

OTHER PUBLICATIONS

Freeworker Swiss Sárl, "Freeworker catalogue," treecare harness 2013, Published on May 29, 2013, 23 pages.

(Continued)

*Primary Examiner* — Daniel P Cahn
*Assistant Examiner* — Candace L Bradford
(74) *Attorney, Agent, or Firm* — Nixon & Vanderhye

(57) ABSTRACT

Harnesses for supporting a person working at height are disclosed. They include a back, leg loops, two forward connection arrangements and a flexible load-bearing member that extends between the connection arrangements, the forward connection arrangements serving to transferring load from the back and the leg loops to the load-bearing member. Each forward connection arrangement includes: a base that is permanently connected to the harness and retention components that can be removably and rigidly connected to the base to removably secure the flexible load-bearing member to the body.

7 Claims, 16 Drawing Sheets

(56) References Cited

U.S. PATENT DOCUMENTS

| | | | | |
|---|---|---|---|---|
| 5,131,490 | A * | 7/1992 | Bell | A62B 1/02 182/7 |
| 8,333,262 | B1 * | 12/2012 | Carpenter | A62B 35/0012 182/6 |
| 8,464,832 | B1 | 6/2013 | Rullo | |
| D685,676 | S | 7/2013 | Tylaska et al. | |
| 9,676,486 | B2 * | 6/2017 | Copenhaver | B64D 17/30 |
| 9,993,669 | B2 * | 6/2018 | Casebolt | A44B 13/0029 |
| 10,016,633 | B2 * | 7/2018 | Perner | A62B 35/0012 |
| 10,112,064 | B2 * | 10/2018 | Bouquier | A62B 35/0006 |
| 10,232,199 | B2 * | 3/2019 | Perner | A62B 35/0031 |
| 2004/0163898 | A1 * | 8/2004 | Bergquist | A62B 1/14 188/65.2 |
| 2004/0194259 | A1 | 10/2004 | Tylaska et al. | |
| 2005/0082114 | A1 * | 4/2005 | Casebolt | A62B 35/0037 182/3 |
| 2009/0314578 | A1 * | 12/2009 | Hede | A62B 35/0012 182/3 |
| 2013/0104351 | A1 * | 5/2013 | Casebolt | A62B 35/0037 24/522 |
| 2014/0224580 | A1 * | 8/2014 | Casebolt | F16B 45/04 182/3 |
| 2015/0231422 | A1 | 8/2015 | Perner | |
| 2018/0154196 | A1 * | 6/2018 | Cowell | A62B 35/0031 |

FOREIGN PATENT DOCUMENTS

| | | | | |
|---|---|---|---|---|
| EP | 2781235 | A2 | 9/2014 | |
| EP | 3162411 | | 5/2017 | |
| EP | 3162411 | A1 * | 5/2017 | A62B 35/0037 |
| FR | 2991590 | A3 | 12/2013 | |
| WO | 92/02128 | A1 | 2/1992 | |

OTHER PUBLICATIONS

Tylaska Marine Hardware, "Dogbones," 2016, 2 pages.
Spinlock, "Mast Pro Harness," 2016, 4 pages.
Robline, "Sirius 500 The Allround Rope Featuring an Excellent Service Life", Jan. 2011, 2 pages.
Feufelberger, "Sirius Accessory Cord," Aug. 2016, 2 pages.

* cited by examiner

HARNESSES

BACKGROUND TO THE INVENTION

Field of the Invention

This invention relates to personal protective equipment and, more particularly, harnesses or components thereof. Particularly, but not exclusively, the invention relates to components used to make a harness suitable for use in supporting a person working at height using rope access and hardware (metal components) that are used within its construction. It also has application for a harness and hardware that are part of a fall-protection system, for example for use by a climber.

A harness may be designed to support a user when working at height, to provide a comfortable body support for performing tasks when suspended from a rope access system. Alternatively or additionally, a harness may be used to arrest a user's fall, for example in a fall protection system used by a climber where there is the potential for a fall. Embodiments of the invention might find application to hardware used for rope access, industrial height safety, rescue, tactical applications, sport climbing, etc. Within this specification, example embodiments will be described that relate to harnesses intended for use in tree care, but this should not be taken to be limiting upon the range of applications of the invention.

SUMMARY OF THE PRIOR ART

This application relates to the components of a harness assembly which is of the general construction shown in FIGS. 1A, 1B and 2.

A known harness is shown in FIG. 1A. The harness comprises two leg loops 10 that, in use, encircle a user's thighs. Each leg loop 10 is connected to a padded back 12 that rests against the small of a user's back and has side wings that extend to above a user's hips when in use. The back has a waist webbing 14 that has ends that can be interconnected by a releasable front waist buckle 16.

Each side wing has a side attachment arrangement 20, shown in more detail in FIG. 1B. Each side attachment arrangement 20 connects the waist webbing 14 in the region of the wing through a riser webbing 18 to the corresponding leg loop 10. In this known arrangement, the side attachment arrangement 20 comprises two metal loops 22, 24 through which the waist webbing 14 passes.

Existing products and designs typically use a multitude of components to create a side attachment assembly. Not only does this produce a side attachment arrangement that is difficult to build into a harness at the manufacturing stage, it also gives limited opportunity following manufacture to replace textile elements, which are susceptible to wear through abrasion or other damage such as cuts, heat damage, and so forth. This can lead to users making their own solutions for repairing a worn side attachment assembly, which is undesirable because the effectiveness of such a repair cannot be guaranteed, or the harness being retired from service while many of its components are still well within their working lives.

Existing harnesses use a pair of symmetric forward attachment arrangements 27 as shown in FIG. 1 to suspend a flexible load bearing member 28 (also known as a "rope bridge") across the front of the harness. For use, the flexible load-bearing member 28 carries a sliding attachment device 29 which attaches to a climbing line. Typical known forward attachment arrangements include a connector 27 shown in FIG. 2 that is sewn in to the riser 18 and leg loop 10 webbing. The flexible load-bearing member 28 is tied in to the connector 27 during manufacture of the harness. The flexible load bearing member 28 can be adjusted in length by repositioning a knot on the one end by the user which is time consuming and potentially hazardous for the user if done incorrectly.

SUMMARY OF THE INVENTION

An aim of this invention is to provide a harness that that overcomes or at least ameliorates these disadvantages.

To this end, from a first aspect, the present invention provides a harness for supporting a person working at height comprising a back, leg loops, two forward connection arrangements and a flexible load-bearing member that extends between the connection arrangements, the forward connection arrangements serving to transferring load from the back and the leg loops to the load-bearing member, in which each forward connection arrangement comprises: a body that is permanently connected to the harness and a retention component that can be removably and typically rigidly connected to the body to removably secure the flexible load-bearing member to the body, and thence to the other components of the harness.

Replacement of the flexible load-bearing member can be achieved by removal of the retention components during servicing of the harness. Suitable formations for connection to the retention components, such as sewn loops, can be provided in the flexible load-bearing member during its manufacture, thereby avoiding the need to form them later, as is the case of a conventional flexible load-bearing member, which has to be securely knotted after it has been installed in the forward connection arrangement.

In embodiments of the invention, the flexible load-bearing member may include a loop and the retention components include a bar that when separate from the body can pass through the loop, and that, when connected to the body, is secured within the loop. The bar is typically secured to the body by bolts and nuts.

In such embodiments, the loop may be formed to include a region which will fail upon application of a force above a threshold but below a maximum working force to cause the effective length of the flexible load-bearing member to increase. This can limit the force that is applied to a user when the harness is acting to arrest a fall.

As an alternative to a bar, the retention component may include a knot blocker. That is, a component with a through hole through which a length of rope can pass, but which prevents the passage of a knotted rope. This can provide a more versatile form of attachment, allowing a user to adjust the length of the bridge by varying the position of a knot upon it.

To provide flexibility in operation, the retention components include an adjuster (e.g., a rope adjuster) that can be caused to grip the flexible load-bearing member at one of a range of positions. Typically, the adjuster allows the effective length of the flexible load-bearing member to decrease by application of a tensile force to a free end of the flexible load-bearing member. The adjuster may allow the effective length of the flexible load-bearing member to increase upon manual intervention by a user prior to application of a tensile force to the flexible load-bearing member.

The secured flexible connecting member passes through the body. This can ensure that the connection between the flexible load-bearing member and the body is not immediately lost in the event that the retention components become detached from the body, for example, as a result of a fastener becoming loose.

A harness embodying the invention may have two similar forward connection arrangements. Alternatively, it may have two dissimilar forward connection arrangements, for example, one having a loop and retention bar arrangement and the other having a rope adjuster arrangement as discussed above.

A harness embodying the invention may have one, two or more flexible connecting members each of which is removably secured to the harness by the or each forward connection arrangement. Typically, the body of each forward connection arrangement is permanently connected to a waist webbing that extends about the back of the harness and the body of each forward connection arrangement is permanently connected to a respective riser that is connected to a respective leg loop.

From a second aspect, the present invention provides a harness for supporting a person working at height comprising a back, leg loops, two forward connection arrangements and a flexible load-bearing member that extends between the connection arrangements, the forward connection arrangements serving to transferring load from the back and the leg loops to the load-bearing member, in which flexible load-bearing member includes an energy dissipation region which will fail upon application of a force above a threshold but below a maximum working force to cause the effective length of the flexible load-bearing member to increase.

The energy dissipation region may include a region that will fail progressively upon the load in the flexible load-bearing member being in excess of the threshold. For example, the energy dissipation region may include stitching that will progressively fail when the load in the flexible load-bearing member being in excess of the threshold.

Optional features of the invention from its first aspect may also be present in embodiments of the invention form its second aspect.

DETAILED DESCRIPTION OF THE PREFERRED EMBODIMENTS

Figure 1A:
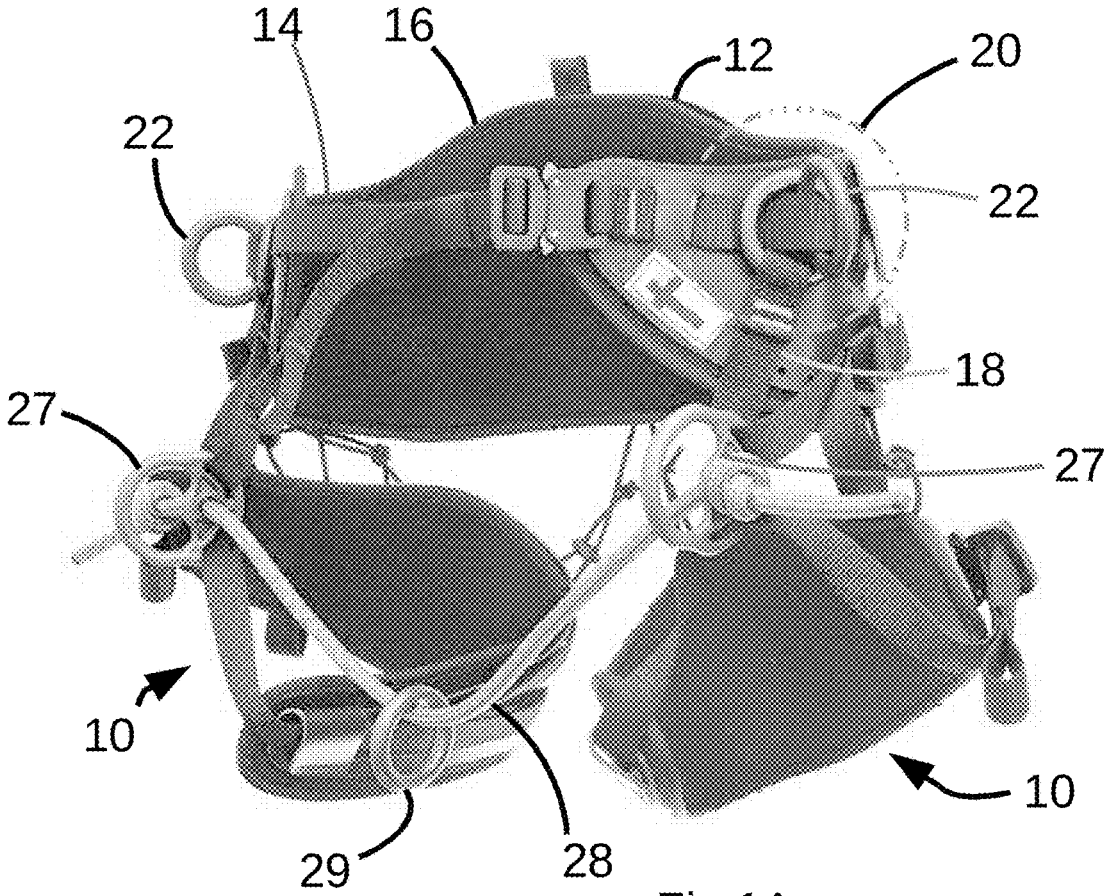
Fig 1A (Prior Art)
FIGS. 1A and 1B show an existing harness, and have already been discussed.

Embodiments of the invention will now be described in detail, by way of example, and with reference to the accompanying drawings.

In the following description, the features described are to be considered as optional features of embodiments of the invention and features described with reference to one embodiment may be incorporated into another.

A harness embodying the invention has a forward attachment arrangement that includes a forward attachment assembly, as shown in FIGS. 3 to 10.

The forward attachment assembly comprises a body 30 and an attachment bar 32.

The body 30 has a generally oval or slight figure-of-8 peripheral shape and is formed from a single piece of metal by a combination of one or more of casting, forging and machining. The body 30 extends in a plane P, having inner and outer surfaces disposed to opposite sides of the plane, and its periphery can be considered as defining a region of the plane through which, six holes pass. The body is symmetrical about an axis A that extends within the plane and that forms a long axis of the body 30.

A bridge hole 40 is centred on the axis A approximately one third of the distance along the axis A from a first end of the axis A. The bridge hole 40 has shape that is square with rounded corners and has a dimension approximately one third of the width of the body 30 in the plane P transverse of the axis A.

A first and a second webbing slot 42, 44 are disposed to opposite sides of the axis A. Each slot 42, 44 extends from a small distance from the axis A that lies between the bridge hole 40 and a first axial end of the body 30, each slot 42, 44 being centred along an arc that is a constant distance from a proximal part of the periphery of the body 30.

There is an attachment hole 46 that extends symmetrically about the axis A to partially surround the bridge hole 40 and to extend to a second axial end of the body 30. This imparts the body 30 with a D-shaped attachment portion extending from the bridge hole 40 in a direction away from the webbing slots 42, 44.

All four above-described holes 40, 42, 44, 46 are formed with curved peripheries and without sharp corners to avoid the creation of stress risers within the body and within any object that is passed through the hole.

Two bolt holes 48 of circular cross-section pass through the body, at an axial position that is approximately half way along the axial extent of the bridge hole. Each bolt hole has one end portion, opening to the inner surface do the body 30, that is countersunk.

The attachment bar 32 has a central portion 50 of round cross-section and two securing portions 52. Each securing portion 52 has a flat mating surface. A bore extends through the securing portion 52 and opens perpendicular to the mating surface. At its opposite end, the bore has a hexagonal counterbore 56.

To assemble the forward attachment assembly a self-locking nut 58 is inserted into the hexagonal counterbore 56 of each bore in the attachment bar 32. A shaft of a respective cap screw 60 is inserted through each bolt hole 48 in the body from the countersunk end into a respective bore in the attachment bar 32 and then screwed into the nuts 58 in the attachment bar 32 and tightened such that the mating surfaces of the securing portions are clamped against the outer surface of the body 30.

Figure 1B:
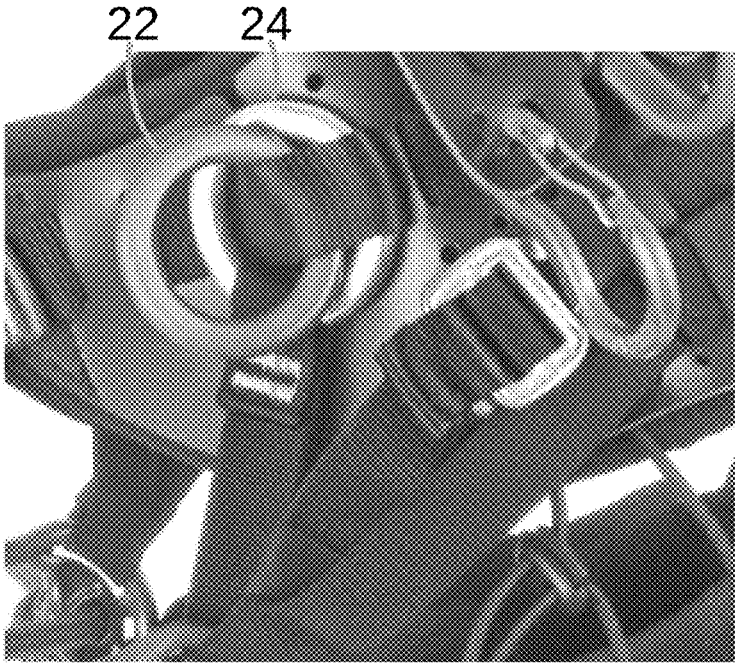
Fig 1B (Prior Art)
Figure 2:
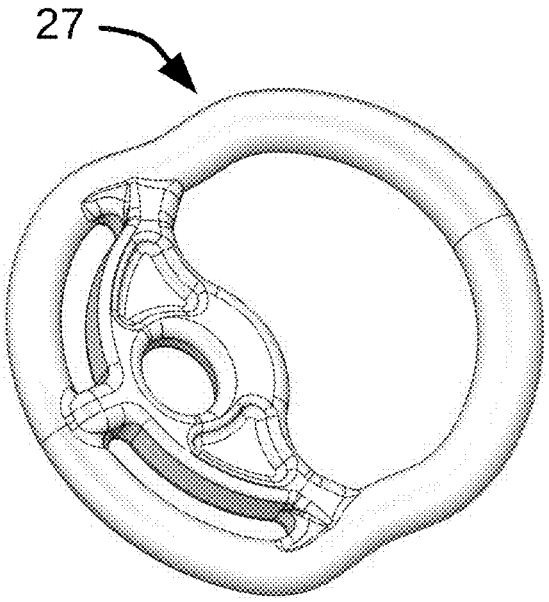
Fig 2 Prior Art
FIG. 2 shows a connector of a forward attachment connector of an existing harness, and has already been discussed.
Figure 3:
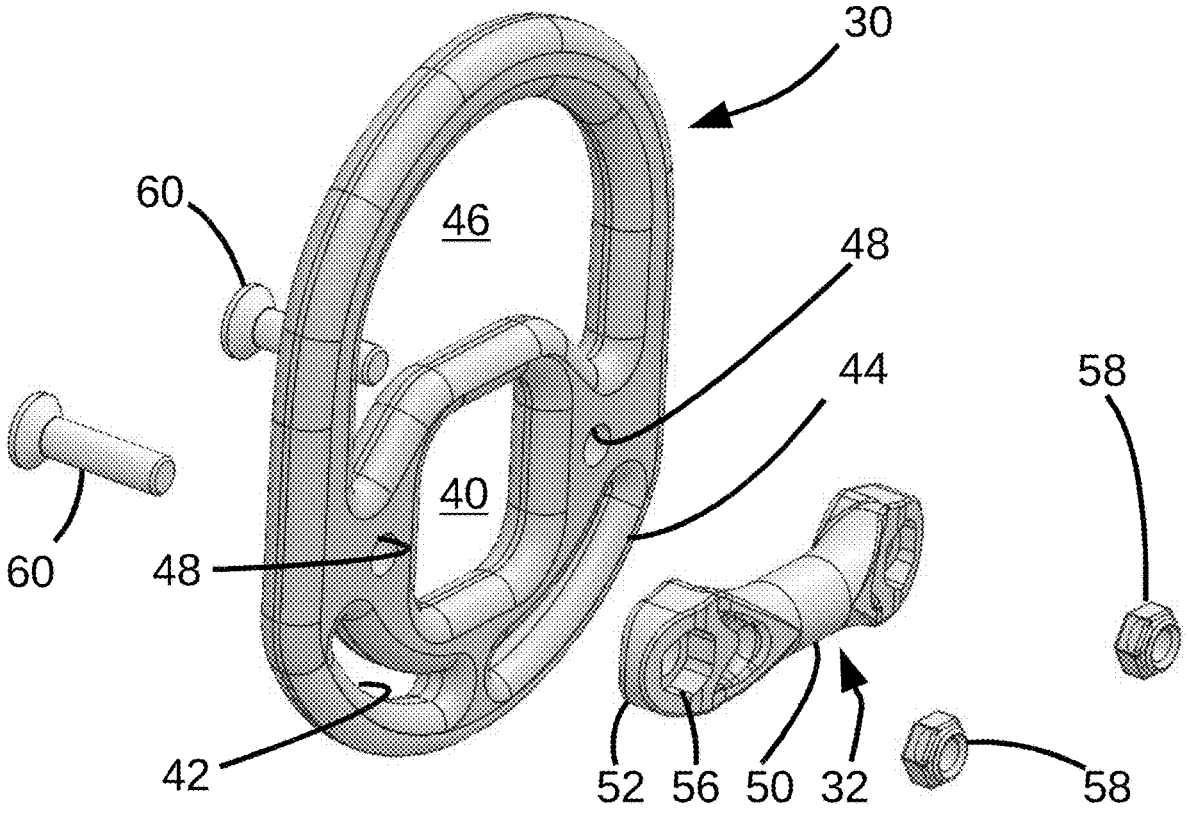
FIG. 3 is an exploded view of a forward attachment assembly being a component of an embodiment of the invention.
Figure 4:
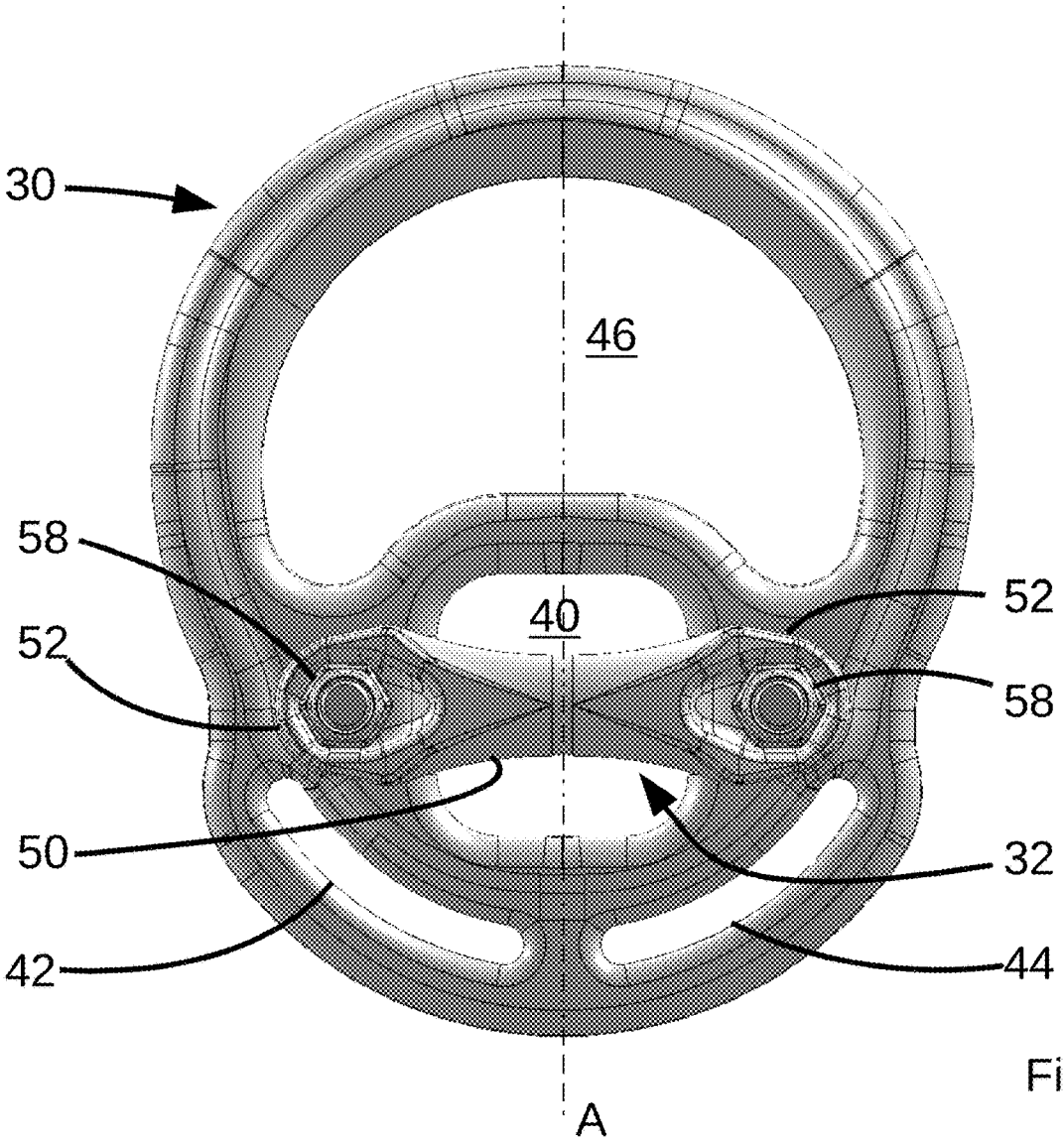
FIG. 4 shows a face view of the assembled forward attachment assembly of FIG. 3.
Figure 5:
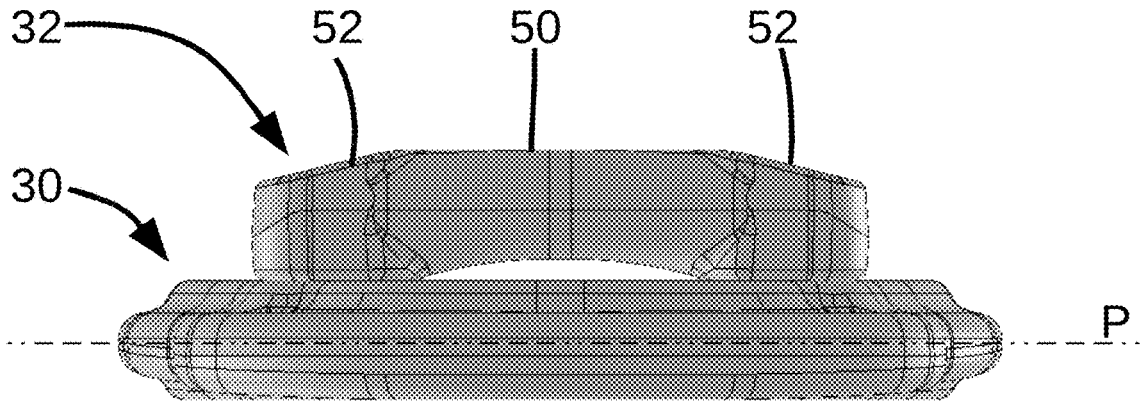
FIG. 5 shows an end view of the assembled forward attachment assembly of FIG. 3.
Figure 6:
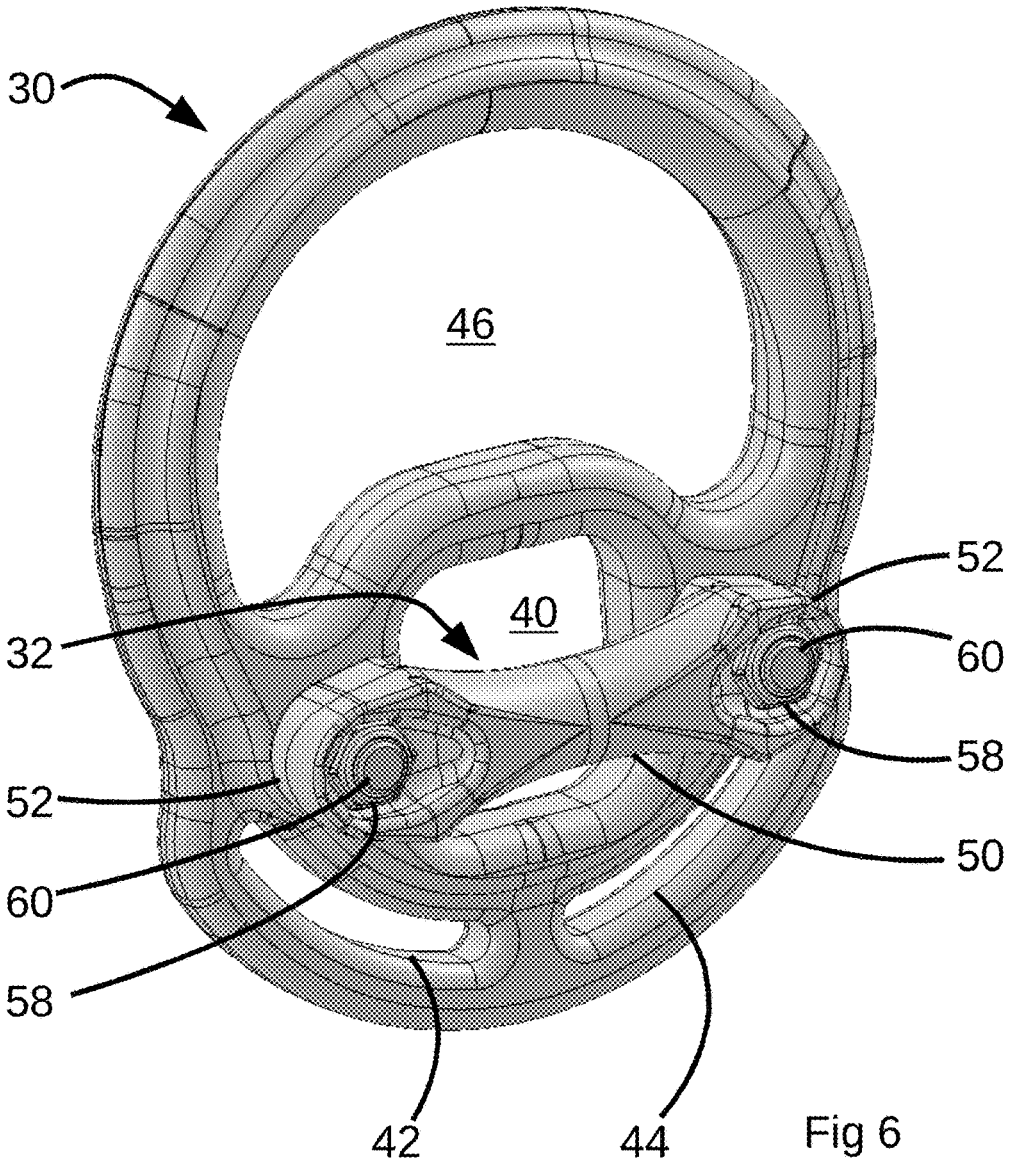
FIG. 6 shows a perspective view of the assembled forward attachment assembly of FIG. 3.
Figure 7:
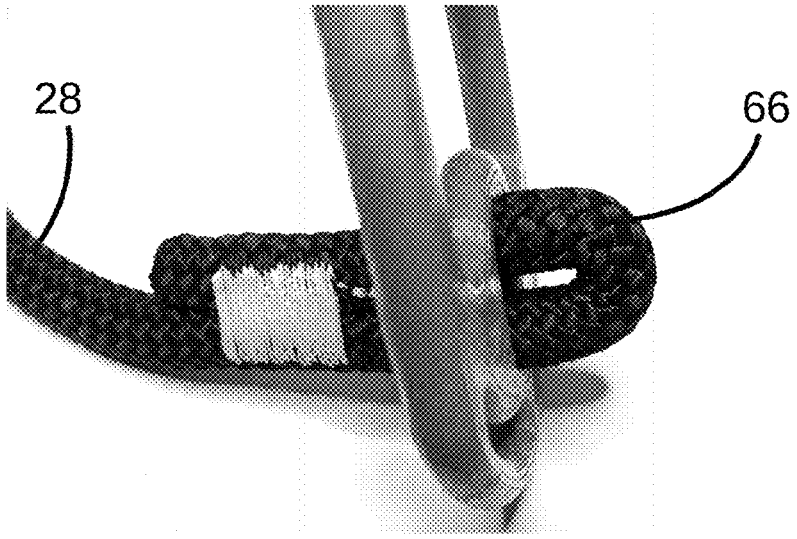
FIG. 7 shows a step in the assembly of a of a forward attachment arrangement of a harness embodying the invention.
Figure 8:
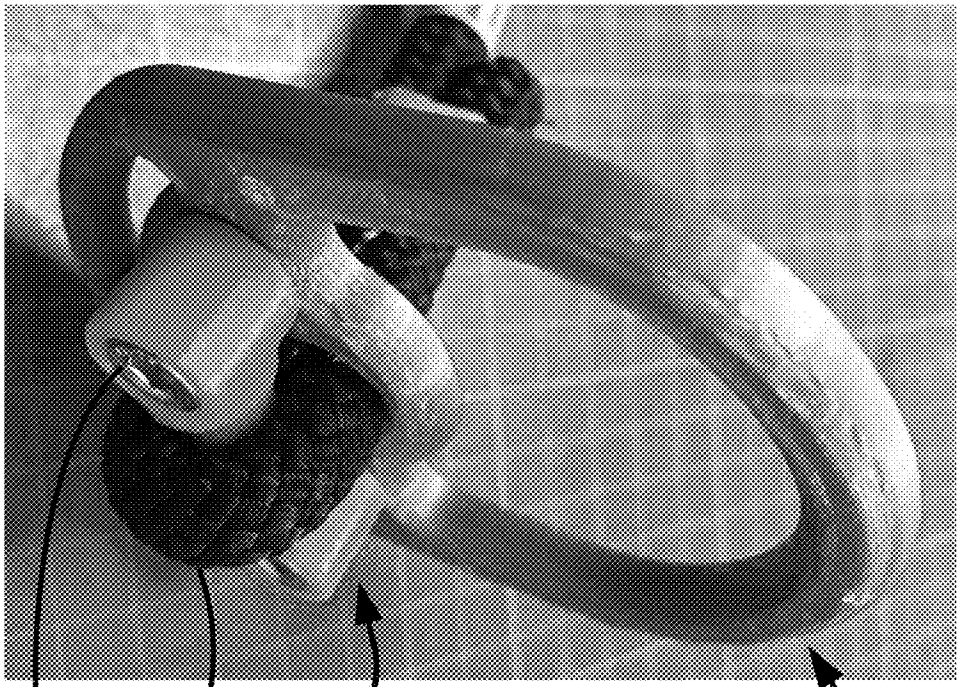
FIG. 8 shows a forward attachment arrangement of a harness embodying the invention with a flexible load-bearing member in place.

The above described attachment arrangement can be incorporated into a harness described in FIGS. 1A and 1B as a replacement for the connector 27 (FIG. 2). The body 30 is permanently installed in the harness by a leg riser webbing and a leg loop webbing passing through the webbing slots 42, 44. The flexible load-bearing member 28 is terminated at each end by a loop 66 that is permanently formed, for example by sewing. With the attachment bar 32 disconnected from the body, each loop 66 is passed through the bridge hole 40 of the body 30 of one of the forward attachment arrangements, as shown in FIG. 7. The attachment bar 32 is then passed into the loop 66 such that it projects by approximately equal distances from both sides of the loop 66. The forward attachment assemblies are then assembled as described in the last-preceding paragraph. This creates a secure connection between the flexible load-bearing member 28 and the forward connection arrangement, as shown in FIG. 8.

The attachment hole 46 defines a loop within the body to which a connector, such as a carabiner, can be connected. This can be used to attach anchors that will help a user to maintain a desired position, or as a point from which items can be carried.

The attachment bar 32 can be considered to be attached to the body 30 semi-permanently, in that it will not be removed during normal use of the harness. However, the connection is made in such a way that the flexible load-bearing member 28 can be removed and replaced as necessary, as part of a service operation, without the requirement that the user of the harness performs potentially risky procedures such as the formation of secure knots in the flexible load-bearing member 28.

Figure 10:
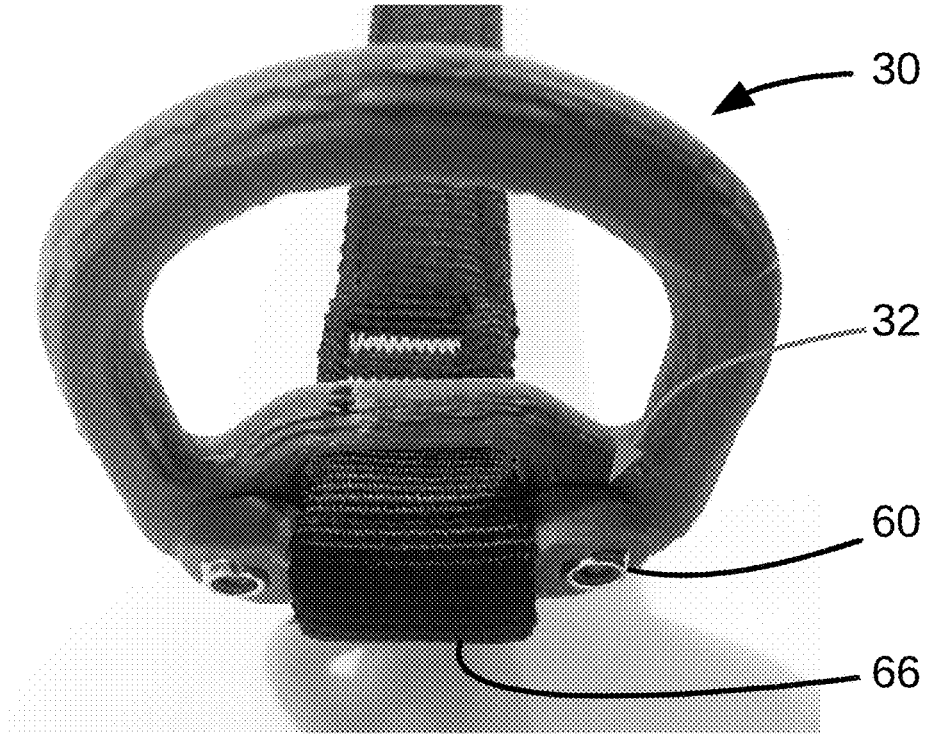
FIG. 10 shows a forward attachment arrangement of a harness embodying the invention with a flexible load-bearing member that is formed from webbing in place.

It is possible to connect two flexible load-bearing members 28 to the same forward connection arrangement by passing the attachment bar through both of their loops 66, 66', as shown in FIG. 10.

Figure 9:
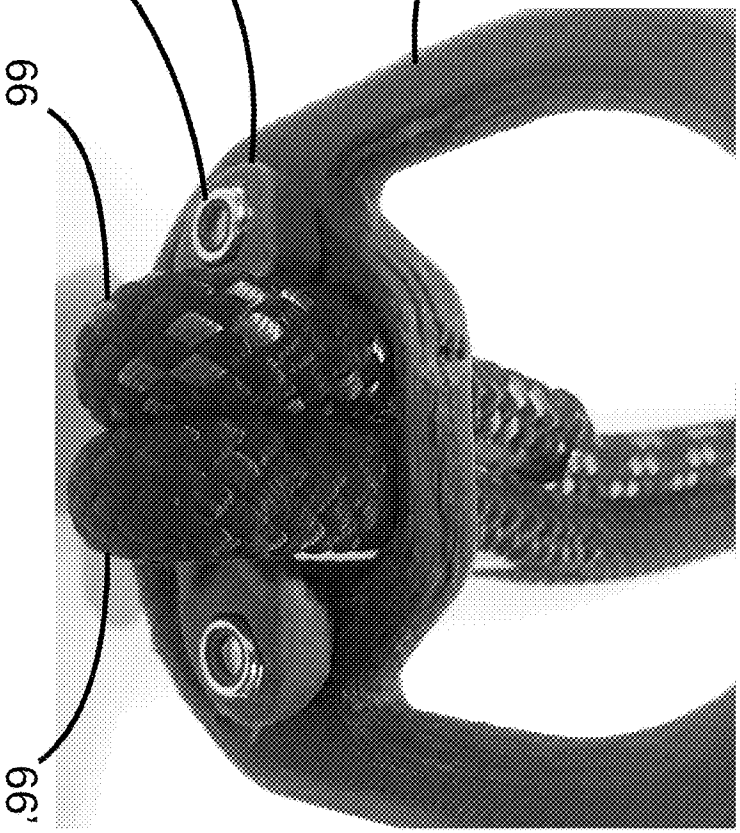
FIG. 9 shows a forward attachment arrangement of a harness embodying the invention with two flexible load-bearing members in place.

The flexible load-bearing members 28 shown above are formed of rope. However, they may have other configurations, such as being made of webbing, as shown in FIG. 9.

In the above-described embodiments, enhanced security of attachment of the flexible load-bearing members 28 is obtained with some loss of flexibility of application, in that the length of the flexible load-bearing members 28 cannot be adjusted. Therefore, in a modification to the embodiments described above, one forward attachment arrangement is provided with means to adjust the length of the flexible load-bearing member 28.

In a variation of the above embodiments, the flexible load bearing member 28 has at least one loop that is constructed in such a way as to limit the force that it can apply to the forward attachment arrangement during normal use to provide shock absorbance in the event that the harness acts to arrest a fall.

The principle of this design of these embodiments is that the attachment bar 32 is held within a double portion of webbing which is sewn together with a holding stitch and a further set of rippable stiches which once loaded by the bar, break sequentially to allow the bar to move through the webbing, effectively extending the length of the flexible load-bearing member 28 until an end-point is reached, with the result that the fall is arrested over a greater distance that would be the case where the loop is simply sewn at the end portion of the flexible load-bearing member 28.

Figure 11:
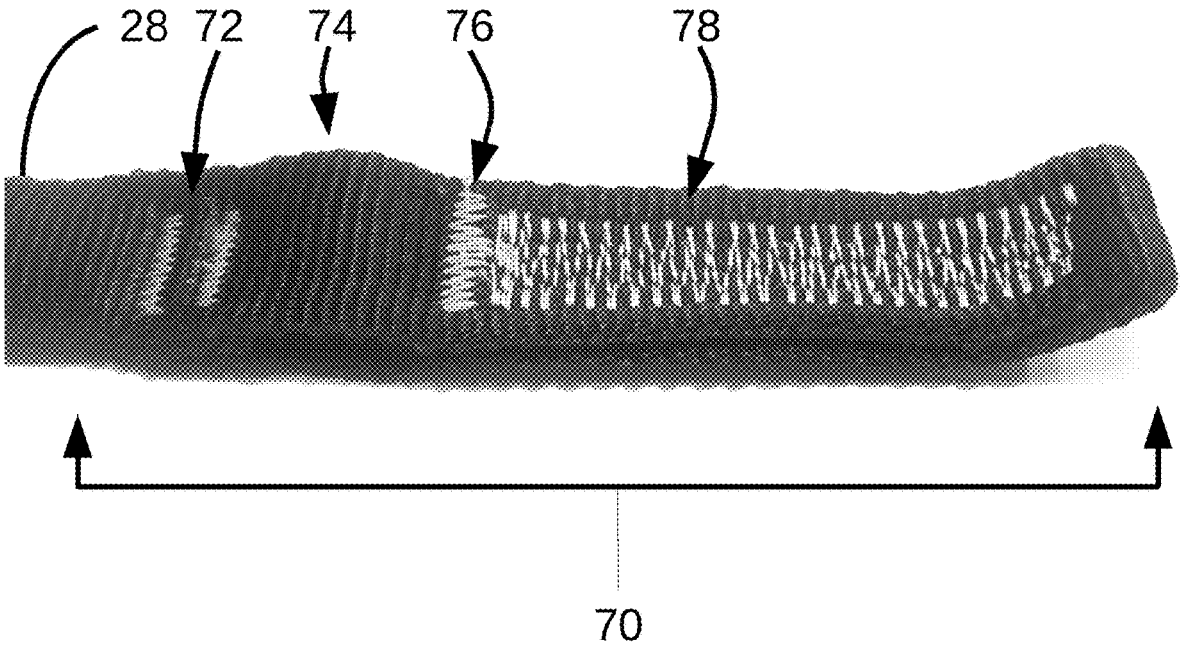
FIG. 11 shows a flexible load-bearing member for use with embodiments of the invention that provides a load-limiting capability.
Figure 12:
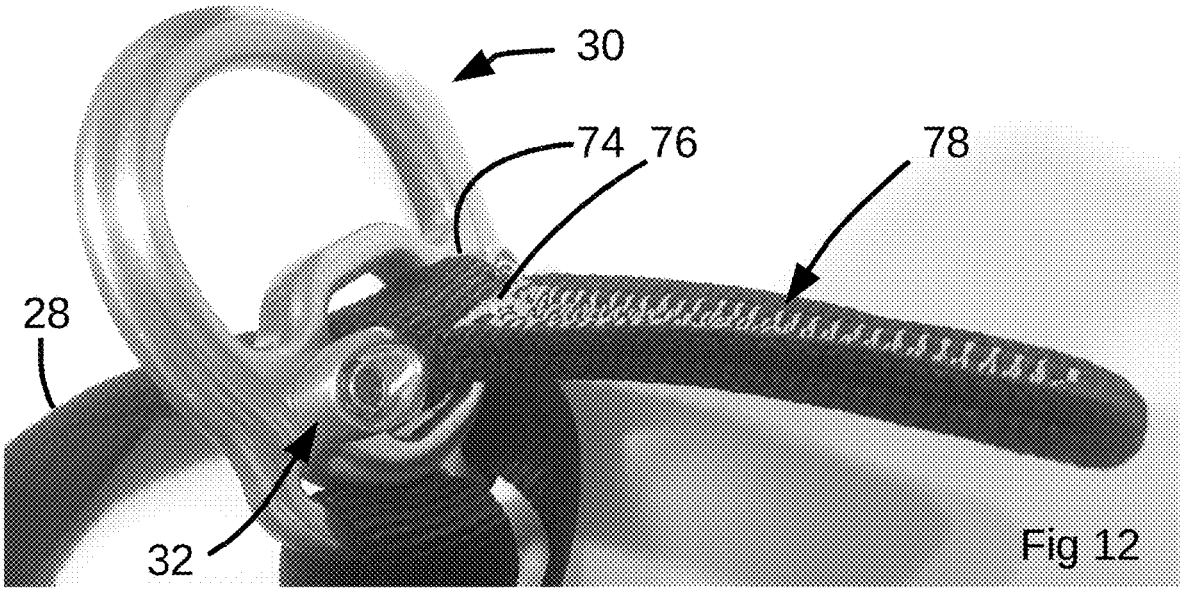
FIG. 12 shows the flexible load-bearing member of FIG. 11 connected to a forward attachment arrangement.

In a first arrangement of a flexible load-bearing member 28 shown in FIGS. 11 and 12, an extended loop 70 is formed at an end of the flexible load-bearing member 28, which in this case is formed from webbing (although a similar arrangement could be formed from rope). The loop 70 is formed by folding an end portion of the webbing back on itself, and retaining it with a first, secure set of retaining stitches 72 that are close to the end of the loop nearest the centre of the flexible load-bearing member 28. The retaining stitches 72 are formed for maximum strength—that is, they should fail only when the absolute load limit of the flexible load-bearing member 28 has been exceeded. Then, outwardly from the retaining stitches 72 is an unstitched region 74, which has an outer boundary formed by a set of holding stitches 76. Outwardly from the holding stitches 76 is a length of rippable stitches 78 that extends to close to the end of the flexible load-bearing member 28.

The flexible load-bearing member 28 is installed onto the forward connection arrangement by passing the attachment bar 32 between lengths of the webbing at the unstitched region 74.

During normal use, the attachment bar 32 is inserted into the unstitched region 74 to be held between the retaining stitches 72 and the holding stitches 76, and the holding stitches will bear the normal working load transferred from the harness through the flexible load-bearing member 28. The holding stitches 76 are configured such that they will fail in the event that the load applied to them by the attachment bar 32 exceeds a threshold that will be encountered during normal use of the harness, such as may arise during arrest of a fall. Once the holding stitches 76 have failed, load is transferred to the rippable stitches 78, which are intended to fail sequentially as the attachment bar 32 passes through them, effectively lengthening the flexible load-bearing member 28 to lessen the decelerative forces applied by the harness to the user. In the event that all of the rippable stiches 78 fail, the attachment bar will come up against the end of the webbing loop, which transfers load back to the retaining stitches 72, to apply sufficient force to arrest the user's fall.

Figure 13:
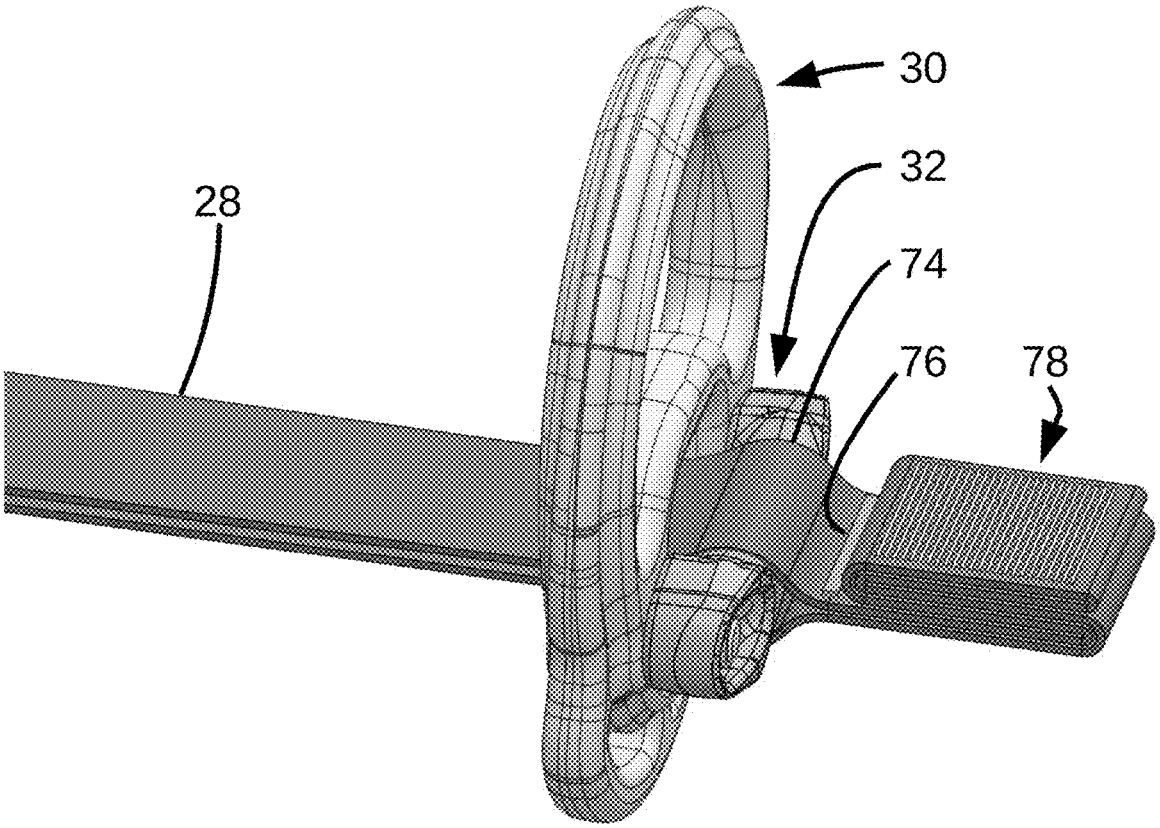
FIG. 13 shows an alternative flexible load-bearing member for use with embodiments of the invention that provides a load-limiting capability
Figure 14:
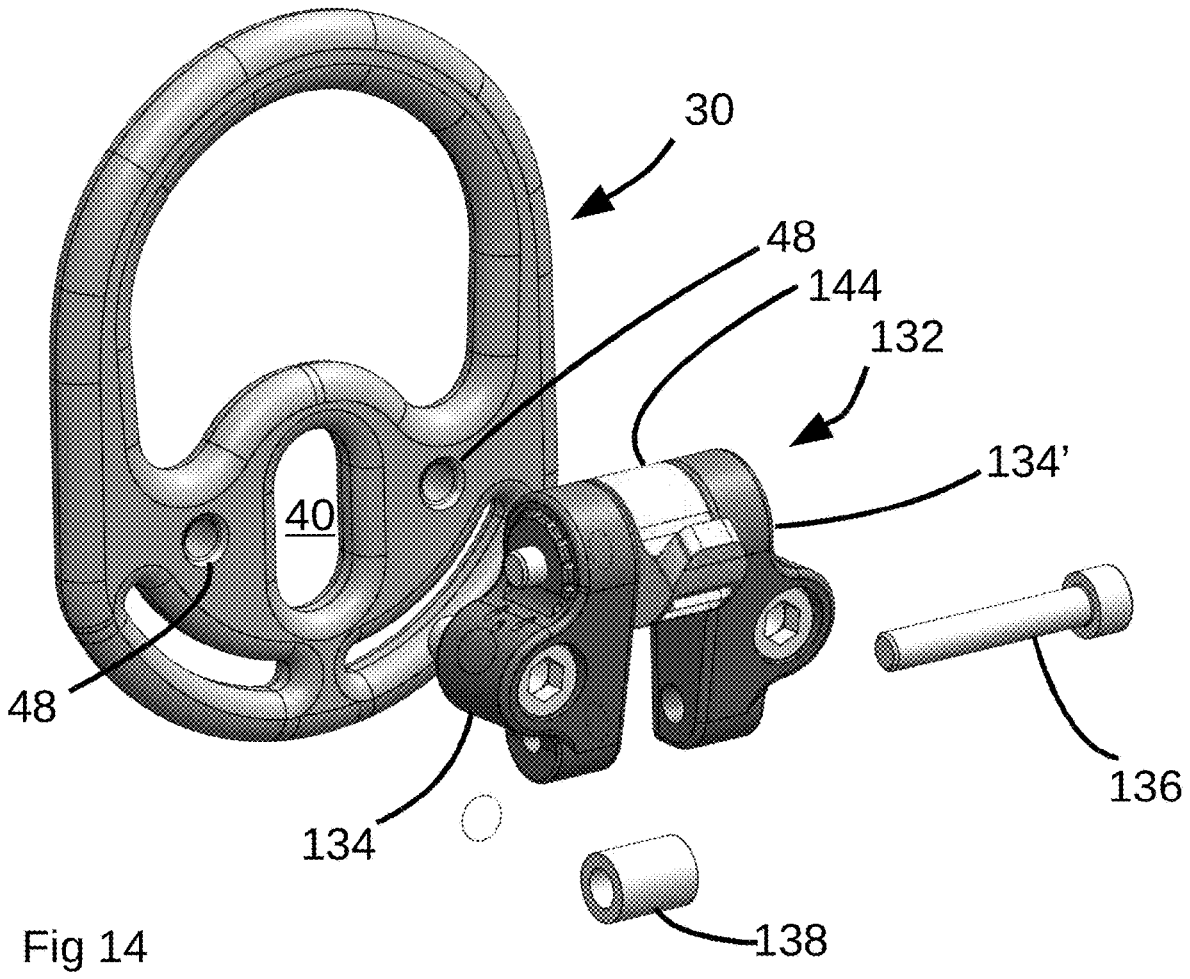
FIG. 14 is an exploded view of an alternative forward attachment assembly being a component of an embodiment of the invention.
Figure 15:
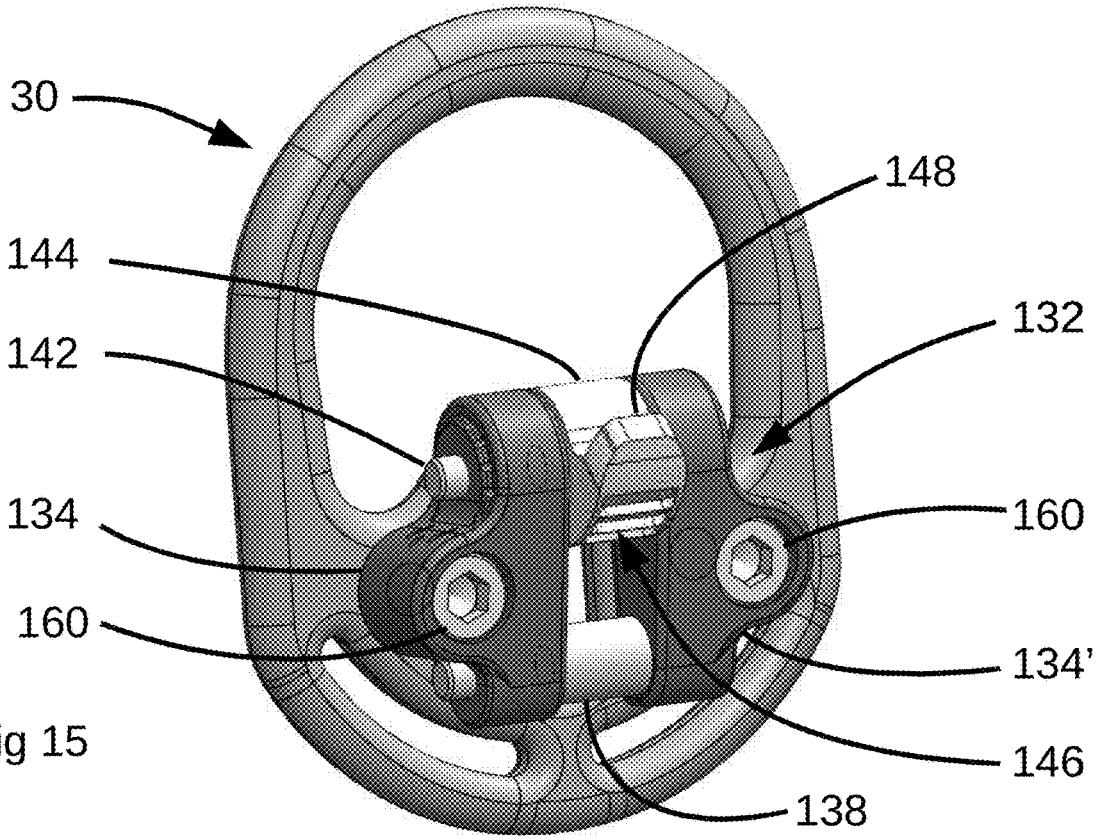
FIG. 15 is an assembled view of the assembly of FIG. 14.
Figure 16:
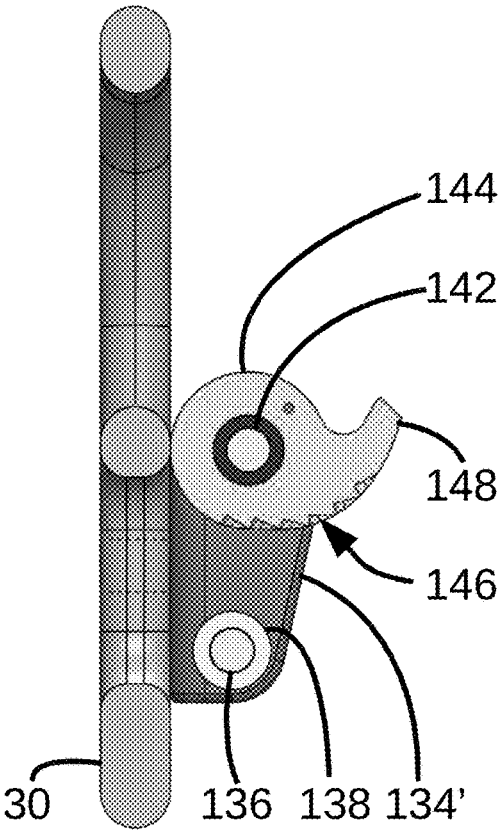
FIG. 16 is a cross-section of the assembly of FIG. 14.
Figure 17:
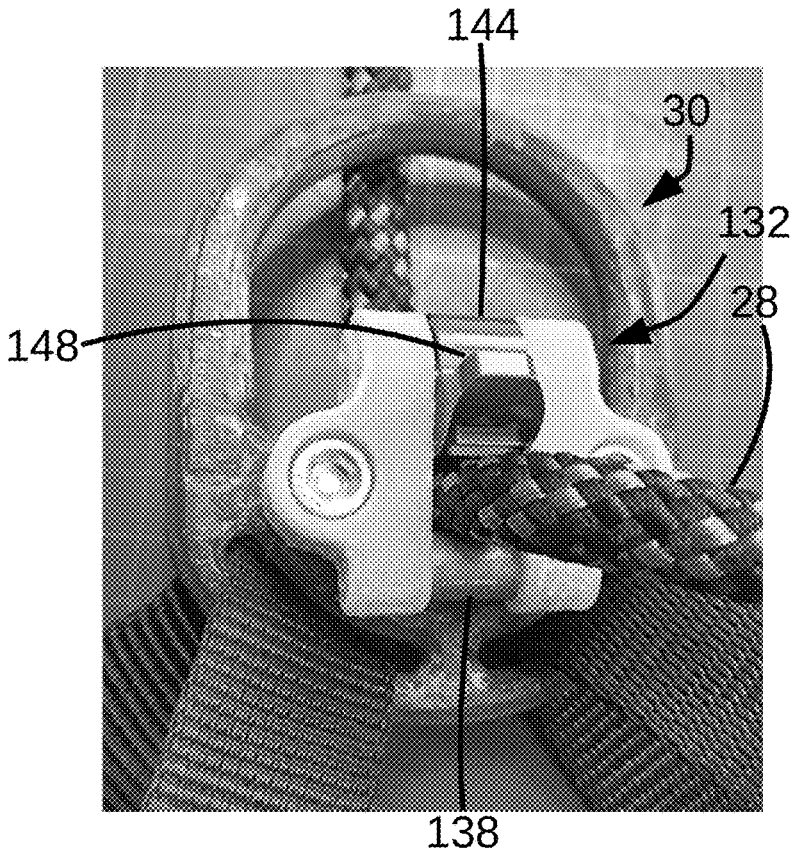
FIG. 17 shows the assembly of FIG. 14 with a flexible load-bearing member and webbing installed.

In the modification of FIG. 13, the length of webbing in which the rippable stitches 78 is formed is folded over upon itself several times. The purpose of this modification is to reduce the length of the flexible load-bearing member 28 that projects beyond the forward attachment arrangement. The folds can be maintained by light stitching or by a removable retaining member, for example, formed of flexible elastic material.

The load limiting arrangement of FIGS. 11 to 13 may be provided at both ends of the flexible load-bearing member or a just one end.

The arrangements of FIGS. 14 to 18 use the same body 30 as in the embodiments described above. In place of the attachment bar 32, a rope adjuster assembly 132 is secured to the body 30 by cap screws 160. The rope adjuster assembly 132 comprises two blocks mirror-image 134, 134', each one being secured through a bolt hole 48 the body 30 by a respective cap screw 160 positioned symmetrically to opposite sides of the bridge hole 40. A carrier bolt 136 extends through a bore in one block 134' and is fixed by being threaded into a tapped bore in the other block 134. A cylindrical boss 138 is carried on the carrier bolt 136 between the blocks 134, 134', the boss 138 being fixed against rotation about the carrier bolt 136. Note that the shape of the boss may be adapted in accordance with the item that it is intended to interact with (a rope, webbing, etc.) to ensure that the grip that it applies is optimised. For example, the surface that faces the cam might be concave, v-shaped or may otherwise diverge from the straight-sided shape shown.

A cam axle 142 extends between the blocks 134, 134', and on it a cam 144 is carried such that the cam 144 can rotate on the axle 142. The cam 144 has a gripping surface 146 that faces generally towards the boss 138, the gripping surface being at a radial distance from the cam axle 142 that increases as the rotational distance of the gripping surface 146 from the boss 138 increases. The gripping surface extends onto a projecting lobe 148 of the cam 144. Gripping formations, such as transverse ridges or grooves, are formed on the gripping surface 146 to increase the friction that will occur between the gripping surface and an object sliding over it.

To assemble the forward attachment arrangement, a flexible load-bearing member 28 is passed through the bridge hole 40 and then placed between the blocks 134, 134'. The boss 138 and the carrier bolt 136 are then fitted, so trapping the flexible load-bearing member 28 between the boss 138 and the cam 144, with the flexible load-bearing member 28 being in contact with the gripping surface 146. The rope adjuster assembly 132 is then bolted to the body 30, which is the same as is the case in the other embodiments described herein.

The cam 144 and the flexible load-bearing member 28 are shaped and dimensioned such that when the cam 144 is rotated away from the body, such that the distance between the gripping surface 146 and the boss 138 is at its greatest, the flexible load-bearing member 28 is gripped, such that linear movement of the flexible load-bearing member 28 through the rope adjuster assembly 132 will urge the cam to rotate. Pulling the flexible load-bearing member 28 through the rope adjuster assembly away from the body 30 urges the cam to turn to a position that maximises the distance between the gripping surface 146 and the boss 138. In this position, the flexible load-bearing member 28 can pass through the rope adjuster assembly 132 with some resistance. If the flexible load-bearing member 28 is pulled in the opposite direction, this urges the cam 144 to rotate in a direction that would reduce the distance between the gripping surface 146 and the boss 138. If a user intervenes to prevent this rotation by applying force to the cam lobe 148, the flexible load-bearing member 28 can move linearly with some resistance. However, if the user does not intervene, the cam 144 will rotate so lessening the distance between the gripping surface 146 and the boss 138. This has the effect of clamping the flexible load-bearing member 28 between the cam 144 and the boss 138, thereby preventing further linear movement of the flexible load-bearing member 28. This allows the user to lengthen or shorten the flexible load-bearing member 28 as required.

An end part of the load bearing member 28 has a formation that prevents it from being fully withdrawn from the rope adjuster assembly 132 (for example, a loop 66 as described above or any other formation that increases its diameter sufficiently to prevent it passing between the cam 144 and the boss 138). This prevents the load bearing member 28 from becoming disconnected inadvertently as it is being lengthened by a user.

By suitable modification of the rope adjuster assembly, a flexible load-bearing member 28 formed from webbing can be used instead of one formed from rope.

Figure 18:
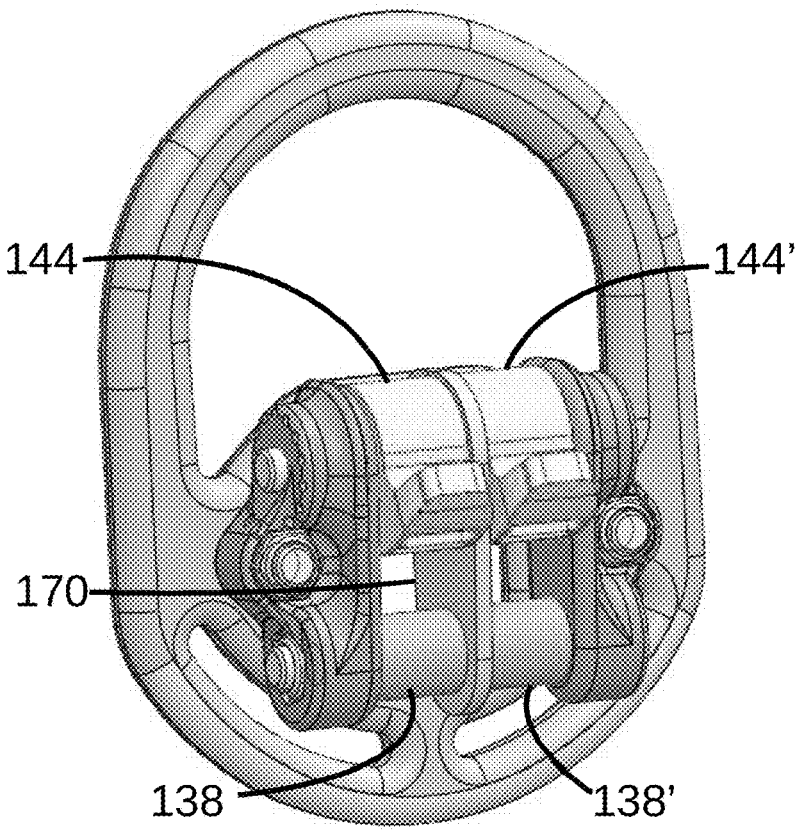
FIG. 18 is a further variation of a forward attachment arrangement of a harness embodying the invention.

In a variation shown in FIG. 18, two cams 144, 144' are carried on the cam axle 142 and two bosses 138, 138' are carried on the carrier bolt 136. A spacer plate 170 extends between adjacent cams 144, 144' and bosses 138, 138'. This allows use and independent adjustment of two flexible load-bearing members 28.

It should be noted that it will normally be necessary to provide a rope adjuster assembly 132 on one of two forward attachment arrangements, with the other using a fixed connection, for example as described with reference to FIGS. 3 to 13.

Figure 19:
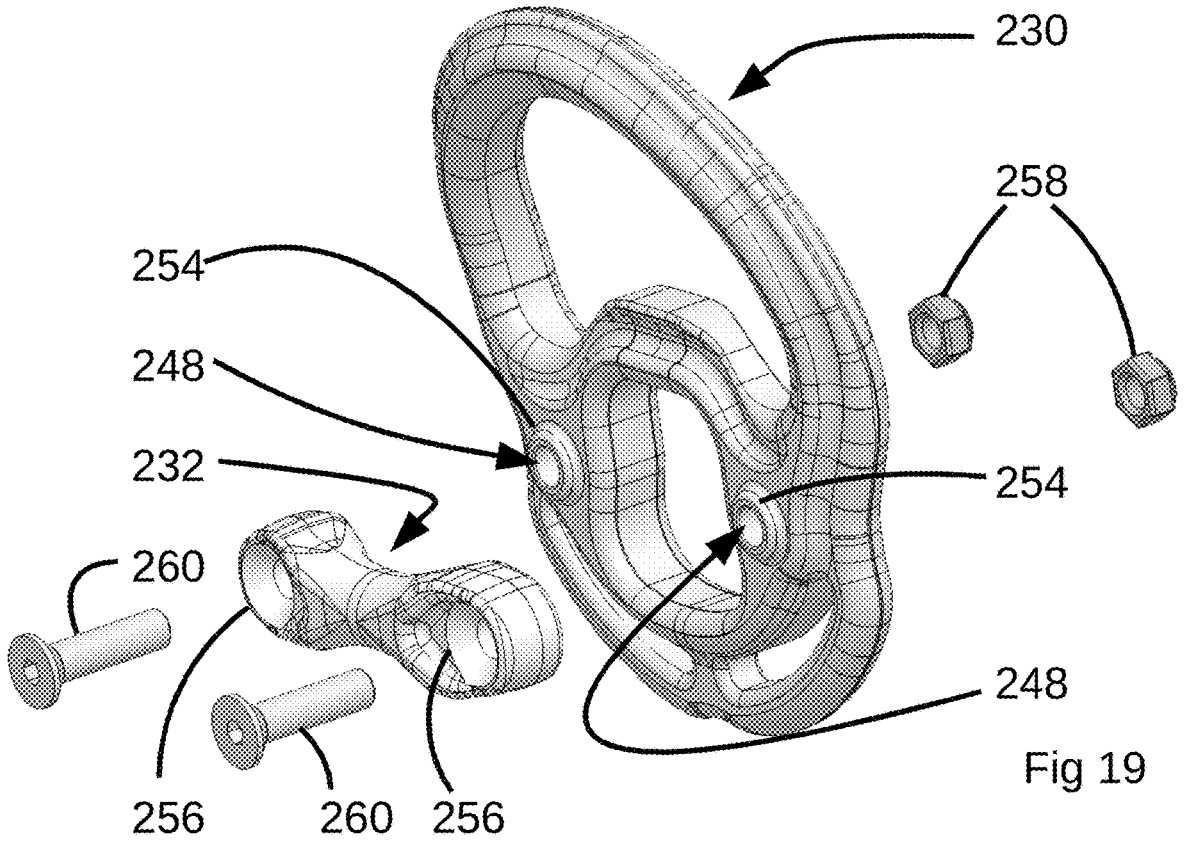
FIGS. 19 and 20 are exploded views of a modification to the embodiment of FIGS. 3 to 6.
Figure 20:
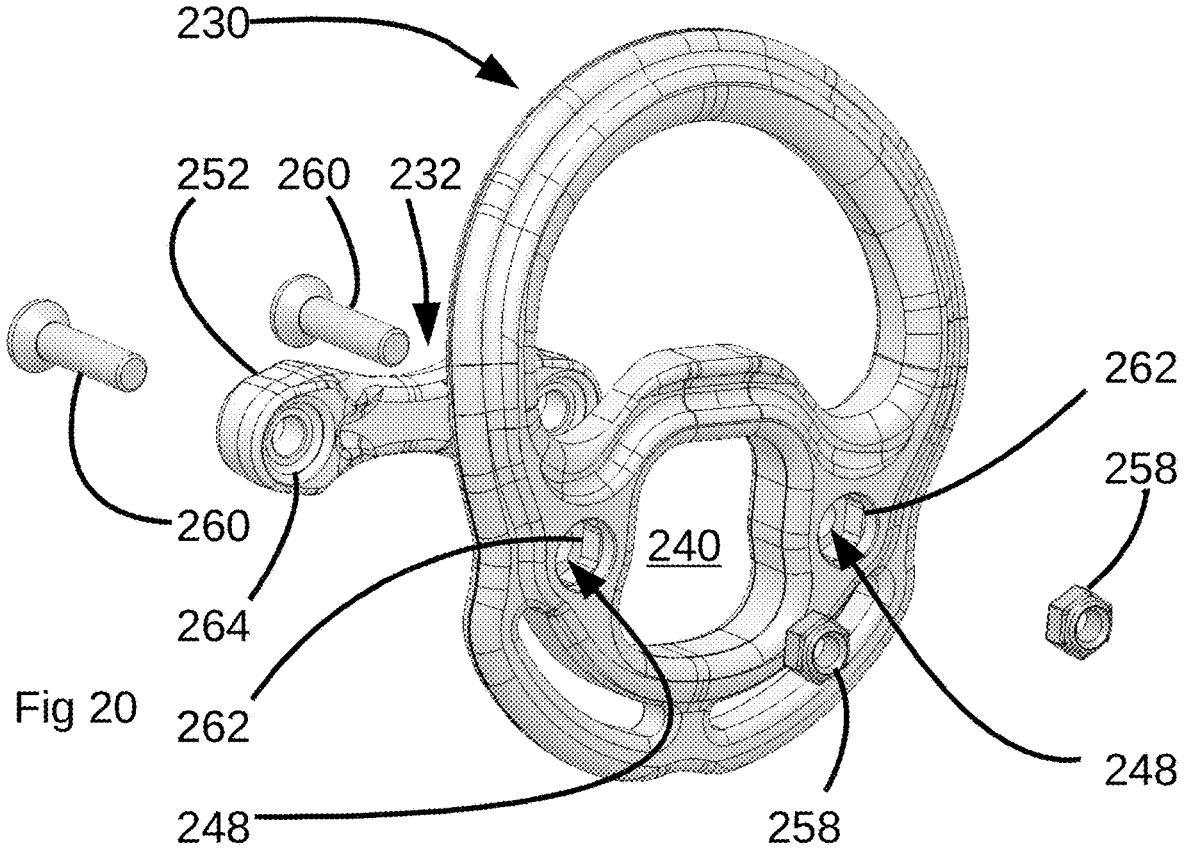

FIGS. 19 and 20 show a modification to the embodiment of FIGS. 3 to 6, although it should be understood that it can be applied to other embodiments described above. This embodiment includes a body 230 that is broadly similar to that described above, with modifications as will now be described.

Instead of lying within a flat plane P, the body 230 in this embodiment is curved, such that the attachment portion extends at a small angle (approximately 15° in this example).

The opening to each bolt hole 248 in the outer surface is surrounded by a ridge 254. At the inner surface, each bolt hole 248 is counterbored and is formed with a hexagonal cross-section 262 inwardly of the counterbore.

This embodiment further includes an attachment bar 232 that is broadly similar to that described above, with modifications as will now be described.

Each securing portion 252 is formed with a recess 264 that surrounds the bore where it emerges from the mating surface. The opposite end portion of the bore is countersunk at 256.

To assemble this embodiment, a self-locking nut 258 is inserted into the hexagonal counterbore 262 of each bolt hole 248. A shaft of a respective cap screw 260 is inserted through the bore of each securing portion 252 of the attachment bar 232. The attachment bar 232 is placed on the outer surface of the body 230 such that each ridge 254 is received in a corresponding one of the recesses 264. The shafts of the screws 260 are passed through the bolt holes 248 in the body 230 to come into threaded engagement with the nuts 258. The bolts are tightened such that the mating surfaces of the securing portions 252 are clamped against the outer surface of the body 230.

The presence of the ridges 254 and recesses 264 serve to locate the attachment bar 232 in the correct position on the body 230 and also prevents the attachment bar 232 being installed in the incorrect orientation. The length and diameter of the head of the screws 260 is selected such that if an attempt is made to fit the attachment bar 232 to the wrong surface of the body 230, the head will not enter the counterbores 262 of the bolt holes 248, and are not long enough to project from the attachment bar 232 so preventing the nuts 258 from being installed.

Figure 21:
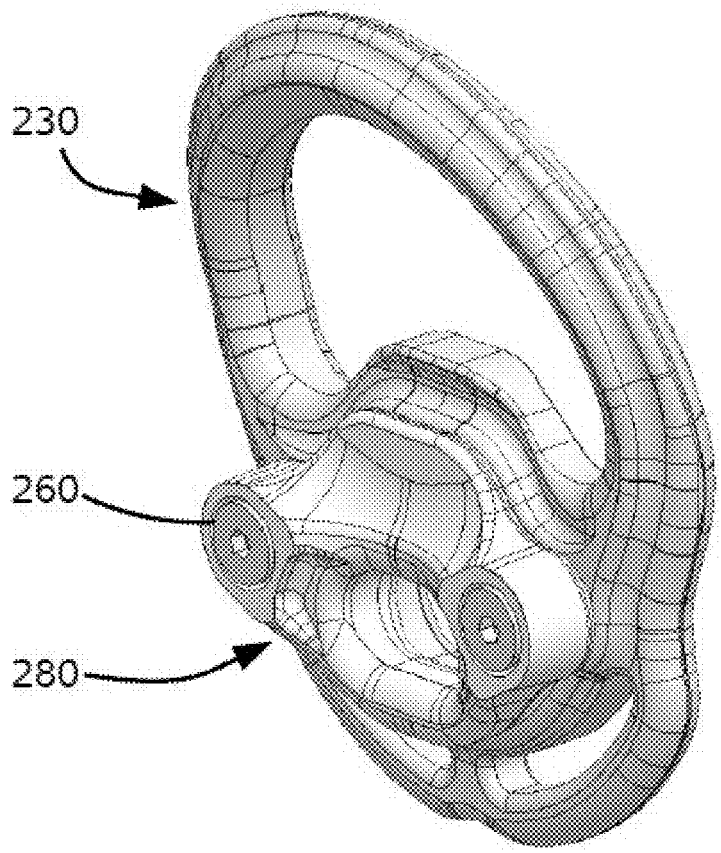
FIG. 21 shows an embodiment being a variation on that of FIGS. 19 and 20.
Figure 25:
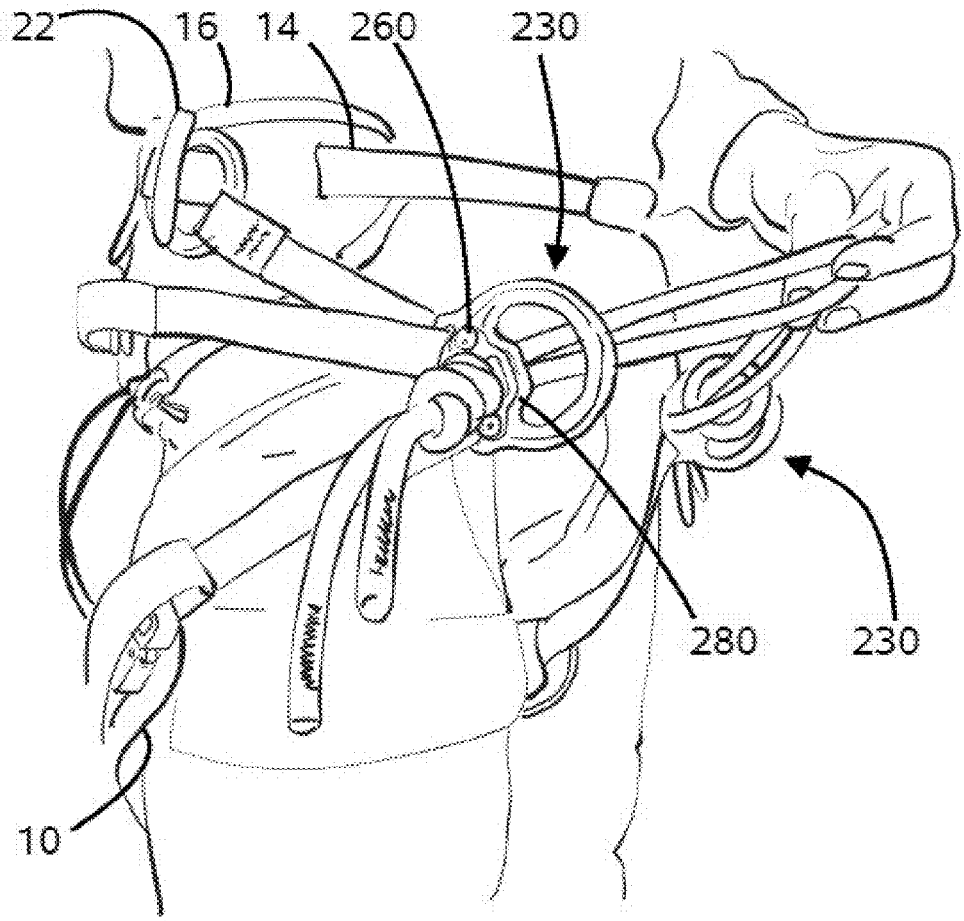
FIG. 25 is a side view of the harness according to at least one embodiment of the present invention.
Figure 26:
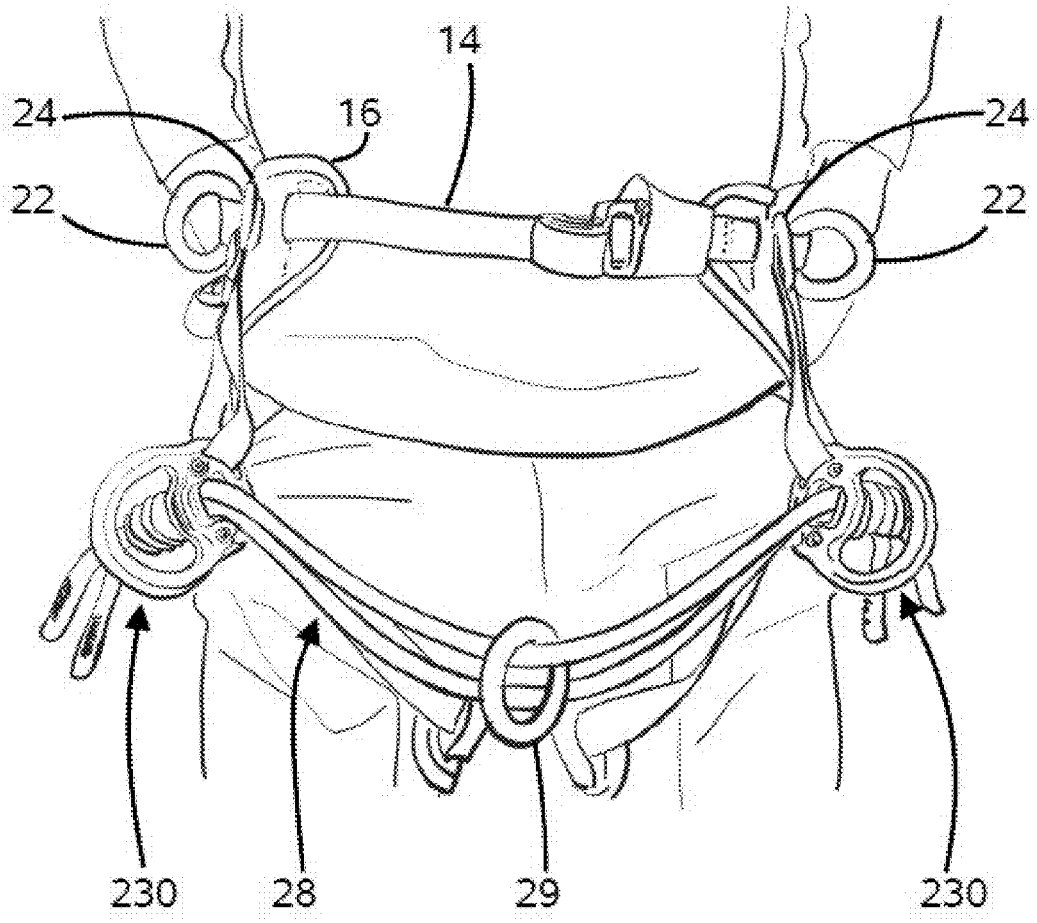
FIG. 26 is a front view of the harness according to at least one embodiment of the present invention.
Figure 27:
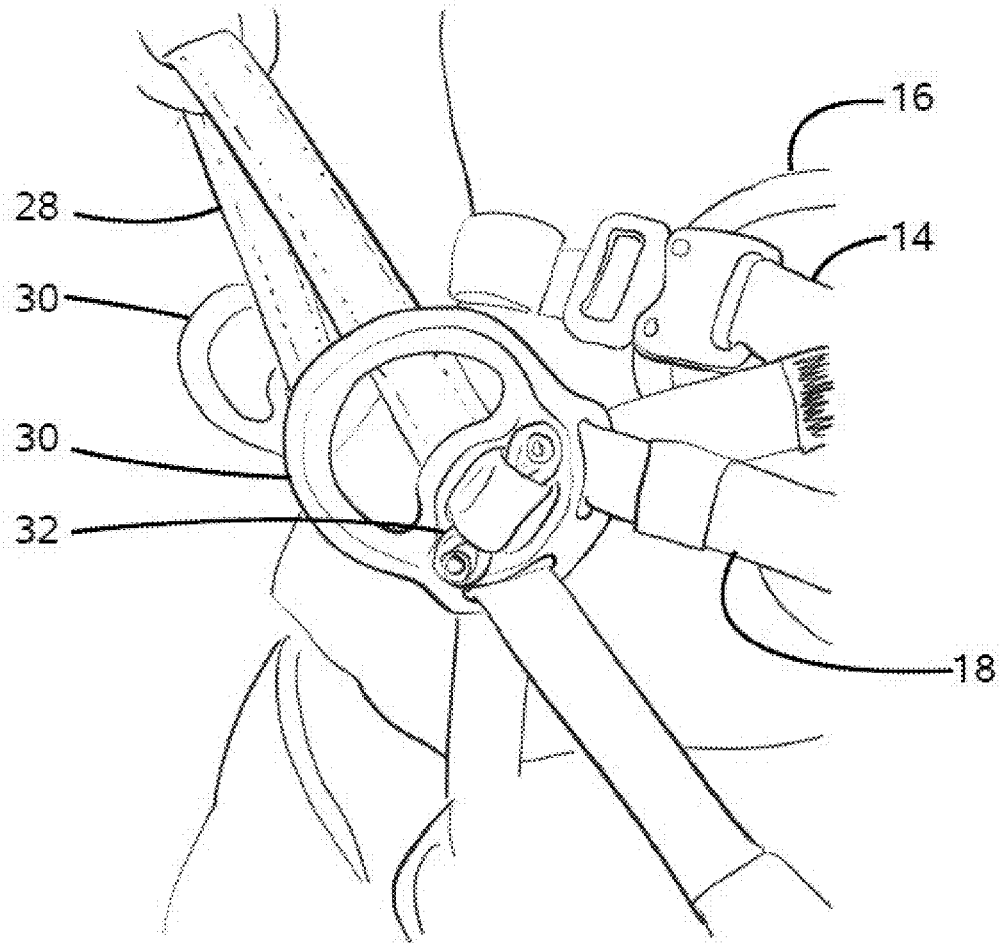
FIG. 27 is a side view of the harness according to at least one embodiment of the present invention.

In the embodiment of FIG. 21, the body 230 is the same as that in the embodiment of FIGS. 19 and 20, and similar nuts and screws 260 are also included. However, the retention component of this embodiment is a knot blocking plate 280, shown in FIGS. 22 and 23. FIGS. 25-27 illustrate side and front views of the harness according to at least one embodiment of the present invention, with the forward connection arrangements of FIGS. 21-24.

The knot blocking plate 280 has a periphery of size and shape such that when it is placed on the body 230 it completely covers the bridge hole 240. An inner surface of the knot blocking plate 280 has a projecting boss 282 surrounded by a flat mating surface. The boss 282 is a close fit within the bridge hole such that when the knot blocking plate 280 is placed onto the body 230, the mating surface comes into contact with the outer surface of the body 230 and the boss 282 enters the bridge hole 240 to locate the knot blocking plate 280 in the correct position on the body 230.

Two bolt holes 248 pass through the knot blocking plate 280. An end portion of each bolt hole 248 adjacent to the outer surface is countersunk at 286. A recess 288 surrounds each bolt hole 248 where it opens to the inner surface of the knot blocking plate 280. As with the attachment bar 230 described above, the presence of the ridges 254 and recesses 288 serve to locate the knot blocking plate 280 in the correct position on the body 230 and also prevents the knot blocking plate 280 being installed in the incorrect orientation. The length and diameter of the head of the screws 260 is selected such that if an attempt is made to fit the knot blocking plate 280 to the wrong surface of the body 230, the head will not enter the counterbores 262 of the bolt holes 248, and are not long enough to project from the attachment bar 232 so preventing the nuts 258 from being installed.

The knot blocking plate 280 has a central rope aperture 288 that extends between the inner and outer surfaces. The rope aperture 288 is shaped as a rounded rectangle and dimensioned such that two lengths of rope that will be used to form the bridge can pass through it side-by-side with little space between the ropes and the material surrounding the rope aperture 288. Adjacent to where it opens to the inner and outer surfaces of the knot blocking plate 280, the rope aperture 288 is flared in order that it presents no sharp or small-radius edges to a rope passing through it.

Figure 22:
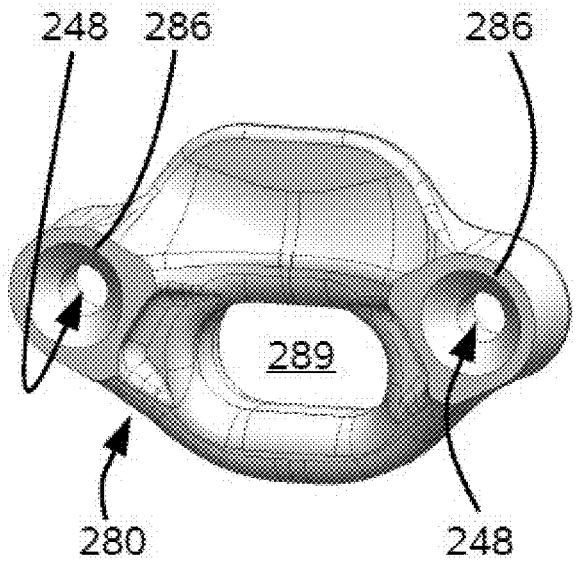
FIGS. 22 and 23 show a component of the embodiment of FIG. 21.
Figure 23:
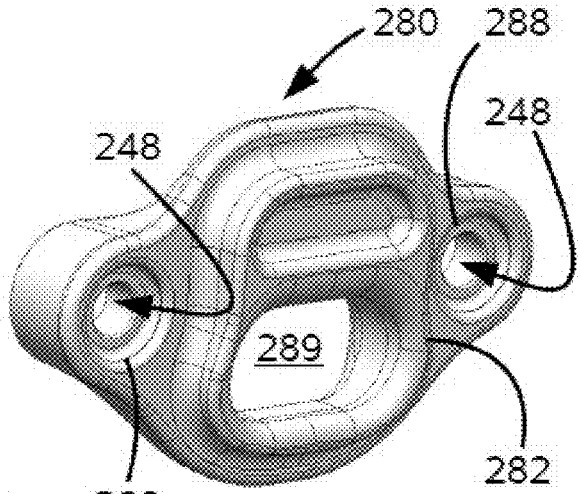
Figure 24:
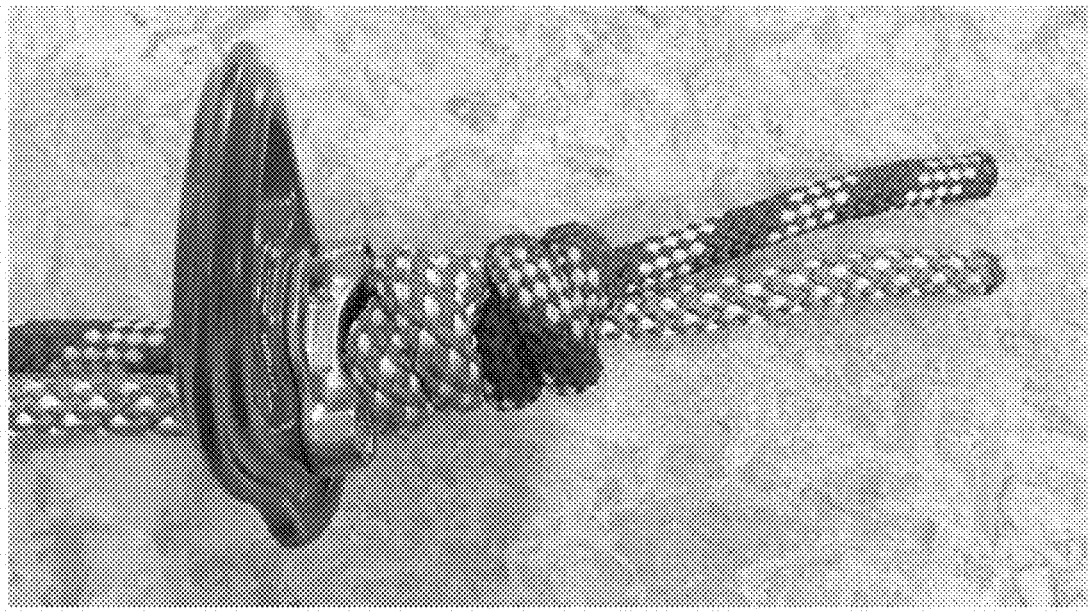
FIG. 24 shows ropes making up a rope bridge installed in the embodiment of FIG. 21.

The rope bridge on a harness that uses the forward connection arrangement shown in FIGS. 21 to 23 is formed by passing two ropes through the rope aperture 288 of each knot blocking plate 280 and tying suitable stopper knots in the ropes to the outside of the knot blocking plates 280, as shown in FIG. 24.

Although some components described above have been formed from rope and some from webbing, the skilled person will realise that, in many cases, one can be substituted for the other.

What is claimed is:

1. A harness for supporting a person working at height, the harness comprising:
- a back (12),
- leg loops (10) that, in use, completely encircle the person's thighs,
- two forward connection arrangements (27), and
- a flexible load-bearing member (28) that extends between the forward connection arrangements,
- an attachment device (29) that attaches to a climbing line, the flexible load-bearing member carrying the attachment device,
- the forward connection arrangements serving to transfer load from the back and the leg loops to the flexible load-bearing member,
- wherein at least one of the forward connection arrangements comprises:
  - a body (230) that has an aperture through which a leg riser webbing of the harness pass to permanently connect the body by sewing to the back and the leg loops of the harness and a bridge hole through which the flexible load-bearing member passes, and
  - a knot blocking plate (280) that can be removably and rigidly connected to the body to removably secure the flexible load-bearing member to the body, the knot blocking plate comprising a central rope aperture (289) through which the flexible load-bearing member passes,
- wherein, with a first side of the knot blocking plate rigidly connected to the body, the bridge hole and the central rope aperture are aligned with a bridge of the flexible load-bearing member passing through the bridge hole and the central rope aperture, the flexible load-bearing member comprised of one or more ropes each with a stopper knot that bears against a second side of the knot blocking plate, and terminal ends of the one or more ropes extending beyond the knots, the knots preventing removal of the ropes from the knot blocking component.

2. The harness according to claim 1, wherein,
- the body, in addition to the apertures through which the leg riser webbing of the harness pass and the bridge hole, comprises two holes for securing the knot blocking plate to the body.

3. The harness according to claim 2, further comprising bolts that extend through the knot blocking plate and the two holes of the body and nuts located in a counterbore (262) of each of the two holes, the nuts engaged with a shaft of the bolts to secure the knot blocking plate to the body.

4. The harness according to claim 1 wherein the forward connection arrangements are similar.

5. The harness according to claim 1, wherein the forward connection arrangements are dissimilar.

6. The harness according to claim 1, wherein the body of each forward connection arrangement is permanently connected to a waist webbing that extends about the back of the harness.

7. The harness according to claim 1, wherein the body of each forward connection arrangement is permanently connected to the leg riser webbing that is connected to a respective leg loop.

* * * * *